US011130160B2

(12) United States Patent
Kasun et al.

(10) Patent No.: US 11,130,160 B2
(45) Date of Patent: Sep. 28, 2021

(54) EMBOSSING FOR ELECTRO DISCHARGE TEXTURED SHEET

(71) Applicant: Arconic Inc., Pittsburgh, PA (US)

(72) Inventors: Thomas J. Kasun, Export, PA (US); Neville C. Whittle, Irwin, PA (US); Patricia A. Stewart, Lower Burrell, PA (US); Shawn J. Clark, Lower Burrell, PA (US); Julie A. Wise, Natrona Heights, PA (US); Karl Eminger, Princeton, IA (US); Dharma Maddala, Pittsburgh, PA (US); Eric Victor Schelin, Elridge, IA (US); June M. Epp, Pittsburgh, PA (US); Wade Winchip, Bettendorf, IA (US); Ian Bath, Murrells Inlet, SC (US)

(73) Assignee: ARCONIC TECHNOLOGIES LLC, Pittsburgh, PA (US)

( * ) Notice: Subject to any disclaimer, the term of this patent is extended or adjusted under 35 U.S.C. 154(b) by 946 days.

(21) Appl. No.: 15/365,476

(22) Filed: Nov. 30, 2016

(65) Prior Publication Data

US 2017/0157655 A1 Jun. 8, 2017

Related U.S. Application Data

(60) Provisional application No. 62/263,193, filed on Dec. 4, 2015.

(51) Int. Cl.
*B21B 37/62* (2006.01)
*B21B 1/22* (2006.01)
(Continued)

(52) U.S. Cl.
CPC ..... *B21B 1/227* (2013.01); *B21B 27/005* (2013.01); *B21H 8/005* (2013.01); *B21B 37/62* (2013.01);
(Continued)

(58) Field of Classification Search
CPC ..... B21B 2001/221; B21B 1/227; B21B 2001/228; B21B 27/005; B21B 37/58;
(Continued)

(56) References Cited

U.S. PATENT DOCUMENTS 2,234,153 A 3/1941 Herbert
4,274,274 A 6/1981 Zacharias et al.
(Continued)

FOREIGN PATENT DOCUMENTS

CN 1638885 A 7/2005
CN 201166253 Y 12/2008
(Continued)

OTHER PUBLICATIONS

Extended European Search Report issued by the European Patent Office in European Application No. 16871421.0 (8 pages), dated Aug. 30, 2019.
(Continued)

*Primary Examiner* — Edward T Tolan
(74) *Attorney, Agent, or Firm* — Greenberg Traurig, LLP

(57) ABSTRACT

An apparatus and method for applying an EDT texture to an aluminum sheet has a rolling stand with at least one EDT surfaced roll capable of rolling the sheet at reductions <1%. The rolling is conducted with residual or no lubrication and imparts a texture on the scale of about 1 μm to the surface of the sheet at low roll force.

28 Claims, 5 Drawing Sheets

(51) Int. Cl.

| | |
|---|---|
| ***B21H 8/00*** | (2006.01) |
| ***B21B 27/00*** | (2006.01) |
| *B21B 45/02* | (2006.01) |
| *B21B 38/08* | (2006.01) |

(52) U.S. Cl.
CPC ..... *B21B 38/08* (2013.01); *B21B 45/0239* (2013.01); *B21B 45/0269* (2013.01); *B21B 2261/14* (2013.01); *B21B 2265/12* (2013.01); *B21B 2265/14* (2013.01); *B21B 2267/10* (2013.01)

(58) Field of Classification Search
CPC ..... B21B 37/62; B21B 38/08; B21B 2261/14; B21B 2265/14; B21B 2267/10; B21B 2267/18; B21B 2003/001; B21H 8/005; B44B 5/0009; B44B 5/0047
See application file for complete search history.

(56) References Cited

U.S. PATENT DOCUMENTS

| | | | | |
|---|---|---|---|---|
| 4,596,130 | A * | 6/1986 | Yoshii | B21B 37/30 72/243.6 |
| 5,025,547 | A * | 6/1991 | Sheu | B21B 1/227 29/527.4 |
| 6,138,490 | A * | 10/2000 | Shannon | F21V 7/10 72/365.2 |
| 6,153,316 | A * | 11/2000 | Shannon | B21B 1/227 428/600 |
| 7,182,825 | B2 | 2/2007 | Unal et al. | |
| 7,516,637 | B2 | 4/2009 | Scamans et al. | |
| 8,322,178 | B2 * | 12/2012 | Kawai | B21B 1/227 72/187 |
| 10,589,327 | B2 * | 3/2020 | Stewart | B21B 45/004 |
| 2003/0024293 | A1 | 2/2003 | Yamamoto et al. | |
| 2007/0068210 | A1 * | 3/2007 | Pittner | B21B 37/165 72/10.1 |
| 2008/0202639 | A1 * | 8/2008 | Tomida | B32B 15/012 148/506 |
| 2010/0035079 | A1 * | 2/2010 | Hasegawa | C21D 7/04 428/600 |
| 2010/0241365 | A1 * | 9/2010 | Goto | G01N 3/08 702/33 |
| 2011/0165430 | A1 * | 7/2011 | Hesse | B21B 1/227 428/573 |
| 2012/0225761 | A1 | 9/2012 | Gaspard et al. | |
| 2013/0122327 | A1 | 5/2013 | Sheu et al. | |
| 2014/0283573 | A1 | 9/2014 | Ishii et al. | |
| 2015/0099170 | A1 | 4/2015 | Motoi et al. | |
| 2015/0115295 | A1 | 4/2015 | Zeng et al. | |
| 2015/0209848 | A1 * | 7/2015 | Kopplin | B21B 1/227 428/659 |
| 2015/0292072 | A1 * | 10/2015 | Mataigne | C23C 2/40 428/659 |
| 2015/0321232 | A1 | 11/2015 | Stewart et al. | |
| 2017/0320114 | A1 * | 11/2017 | Kohlrausch | B21B 1/227 |
| 2017/0355002 | A1 * | 12/2017 | Karhausen | B21B 1/227 |

FOREIGN PATENT DOCUMENTS

| | | | |
|---|---|---|---|
| CN | 103372567 | A | 10/2013 |
| CN | 103510012 | A | 1/2014 |
| CN | 104160536 | A | 11/2014 |
| CN | 105080979 | A | 11/2015 |
| CN | 205080979 | U | 3/2016 |
| EP | 1344580 | A1 | 9/2003 |
| JP | 63-255320 | | 10/1988 |
| JP | 63299802 | A | 12/1988 |
| JP | 1992-274802 | A | 9/1992 |
| JP | 2004-130352 | A | 4/2004 |
| JP | 2004-218012 | A | 8/2004 |
| JP | 2006-504529 | A | 2/2006 |
| JP | 2011-255679 | A | 12/2011 |

OTHER PUBLICATIONS

PCT International Search Report and the Written Opinion of the International Searching Authority, International Application No. PCT/US2016/064213 filed Nov. 30, 2016.

* cited by examiner

EMBOSSING FOR ELECTRO DISCHARGE TEXTURED SHEET

CROSS REFERENCE TO RELATED APPLICATIONS

This application claims the benefit of U.S. Provisional Application No. 62/263,193, entitled, Embossing for Electro Discharge Textured Sheet, filed Dec. 4, 2015, which application is incorporated by reference herein in its entirety.

FIELD

The present invention relates to apparatus and methods for rolling metal into sheets and more particularly, to applying a surface texture to the metal sheet.

BACKGROUND

Various methods for producing sheet metal having a given surface texture are known. For example, a surface texture such as that achieved by rolling a sheet with rolls that have been treated by Electro Discharge Texturing (EDT) may be applied to aluminum, steel and other metal surfaces in a low reduction (3 to 5% or at 8 to 10%) post-cold-rolling operation, resulting in 40-60% roll roughness transfer. Reductions with EDT rolls in the range of 3-5% or 8-10% result in debris generation during the rolling process due to the large number of asperities on the roll surface and slip in the roll bite. This debris often ends up on the sheet and may require an additional cleaning step after rolling or during customer processing. EDT rolling in an in-line skin pass slows line speed considerably and requires roll changes at the EDT cold roll station, depending upon whether texturing or running at full speed without texturing is desired. A cold mill or skin pass mill involves a significant investment in capital dependent on the type of mill and the capacity desired. Improved and alternative methods and apparatus for texturing sheet therefore remain desirable.

SUMMARY

The disclosed subject matter relates to a method for applying texture to a metal sheet, including rolling the sheet at a rolling stand with a roll having an EDT surface at a reduction of <1% at a roll force level producing a surface roughness on the sheet in a range of about 1 μm to 5 μm.

In an embodiment of the present disclosure, the roll force level is maintained by at least one of at least one hydraulic cylinder or mechanical actuator.

In another embodiment of the present disclosure, the roll force is maintained within a range of +/−0.3 to 0.5% of total roll force.

In another embodiment of the present disclosure, the roll force is maintained within a range of +/−0.1% of total roll force.

In another embodiment of the present disclosure, the roll force is maintained within a range of +/−1 to 5 tons of the total roll force. In another embodiment of the present disclosure, the surface roughness imparted to the sheet is in the range of about 1 μm to 1.5 μm Sa.

In another embodiment of the present disclosure, the surface of the sheet is redistributed by the step of rolling to a depth of about 1 μm to 2 μm.

In another embodiment of the present disclosure, the sheet has a width of from about 1.5 m to about 1.85 m and the roll force exerted by the roll with an EDT surface is in the range of about 200 to 350 metric tons.

In another embodiment of the present disclosure, the roll force is measured by load cells and/or pressure transducers and the force data is used to control the hydraulic or mechanical actuator(s) that regulate the roll force.

In another embodiment of the present disclosure, the rolling step is conducted by a 2 high rolling stand.

In another embodiment of the present disclosure, the rolling stand is an embossing mill or similar apparatus with at least one roll being the roll with an EDT texture.

In another embodiment of the present disclosure, both rolls of the 2 high rolling stand are EDT textured.

In another embodiment of the present disclosure, the metal sheet after the step of rolling has a peak count of 20 to 100 peaks/cm using a cutoff threshold +/−Sa/2 of about 0.5 μm.

In another embodiment of the present disclosure, the roll with an EDT surface has a diameter in the range of about 300 to 500 mm.

In another embodiment of the present disclosure, the roll with an EDT surface has a crown of about 0.635 mm.

In another embodiment of the present disclosure, the metal sheet is pulled through the rolling stand.

In another embodiment of the present disclosure, a coiling system pulls the metal sheet through the rolling stand and drives the roll with an EDT surface.

In another embodiment of the present disclosure, the metal sheet is driven through the rolling stand.

In another embodiment of the present disclosure, the sheet is an output of a rolling mill, prior to being rolled by the rolling stand with the roll having an EDT surface.

In another embodiment of the present disclosure, the sheet output by the rolling mill prior to rolling with the roll having an EDT surface is within 99% of its final dimensional size.

In another embodiment of the present disclosure, the sheet before rolling with the roll having an EDT surface is in the range of about 0.8 mm to 1.1 mm in thickness.

In another embodiment of the present disclosure, the sheet before rolling with the roll having an EDT surface is in the range of about 0.5 mm to 5 mm in thickness.

In another embodiment of the present disclosure, the sheet before rolling with the roll having an EDT surface is in the range of about 0.5 mm to 20 mm in thickness.

In another embodiment of the present disclosure, the sheet before rolling with the roll having an EDT surface is in the range of thickness that may be processed by an embossing mill. In another embodiment of the present disclosure, the sheet before rolling with the roll having an EDT surface is in the range of about 0.8 mm to 1.1 mm in thickness.

In another embodiment of the present disclosure, no lubricant is applied to the sheet prior to rolling with the roll having an EDT surface.

In another embodiment of the present disclosure, further including cleaning the sheet prior to rolling with the roll having an EDT surface.

In another embodiment of the present disclosure, the cleaning step removes lubricant from the sheet.

In another embodiment of the present disclosure, the EDT roll is cleaned during rolling of the sheet.

In another embodiment of the present disclosure, the EDT roll is cleaned after it rolls the sheet.

In another embodiment of the present disclosure, the sheet is cleaned after the step of rolling with the roll having an EDT surface.

In another embodiment of the present disclosure, the transfer percentage during the rolling step is in a range of about 80% to 100%.

In another embodiment of the present disclosure, the line speed of the sheet during the rolling step is in the range of 10 to 500 m/min.

In another embodiment of the present disclosure, the EDT rolling stand is selectively positionable in a roll line to allow running the roll line with or without the EDT rolling stand.

In another embodiment of the present disclosure, the EDT rolling stand is selectively on/off line or opened and closed to allow running the roll line with or without the EDT rolling stand.

In another embodiment of the present disclosure, further including the step of thermally treating the sheet either before or after rolling with the roll having an EDT surface.

In another embodiment of the present disclosure, further including forming a vehicle panel from the sheet after having imparted a texture to the sheet by the step of rolling.

In another embodiment of the present disclosure, a sheet product produced by rolling the sheet at a rolling stand with a roll having an EDT surface at a reduction of <1% at a roll force level producing a surface roughness on the sheet in a range of about 1 μm to 5 μm.

BRIEF DESCRIPTION OF THE DRAWINGS

For a more complete understanding of the present disclosure, reference is made to the following detailed description of exemplary embodiments considered in conjunction with the accompanying drawings.

DETAILED DESCRIPTION OF EXEMPLARY EMBODIMENTS

Figure 1:
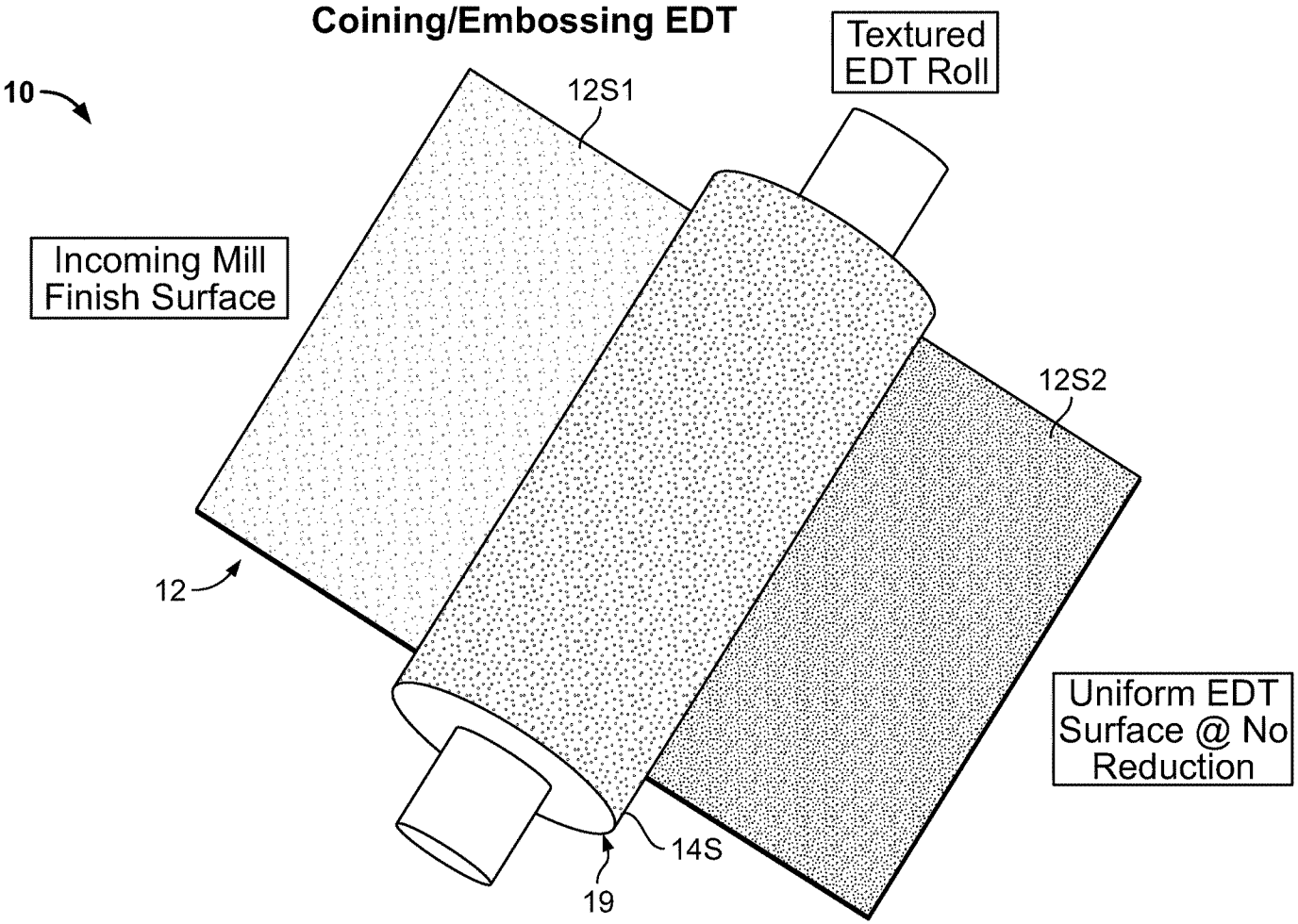
FIG. 1 is a perspective view of a rolling apparatus in accordance with an embodiment of the present disclosure.

An aspect of the present disclosure is the recognition that an embossing mill may be used to impart a metal sheet with an EDT texture at low reductions of, e.g., <1%. This use of an embossing mill may be effective in conferring an EDT texture to a metal sheet, e.g., for use in automotive panel application. Imparting an EDT texture at reductions of <1% may result in a sheet with better surface quality because less debris is generated. In addition, less energy is required since reductions <1% do not require as much roll force as that required to make a substantial reduction in thickness. In one example of a rolling operation conducted in accordance with the present disclosure, the rolls are pressed together by a force of about 200 to 350 metric tons, for sheet widths of 60" and 73" (1.54 m and 1.85 m), respectively. Because embossing mills are less capital intensive than cold rolling mills, use of an embossing mill to impart EDT texture may result in a more efficient use of resources than use of more expensive cold rolling mills, which if present, can be used for other functions. While embossing mills are known for imparting patterns to sheet metal at roll pressures of 100 to 400 metric tons, the patterns applied are typically coarse, e.g., having a surface roughness Ra in the range of about 25 μm to 250 μm and typically are a consequence of localized bending of the sheet (the entire thickness thereof) to accomplish a visible deformation pattern. In contrast, EDT textures applied during a cold rolling/skin pass typically have a surface roughness on the scale of 1 μm to 1.5 μm and are generally thought to be achievable only at substantial reductions in thickness in the range of 3-5% or 8-10% using high roll pressure. The range of surface roughness for EDT in accordance with the present disclosure is 1 to 5 μm, in another embodiment 1 to 2 μm and in another embodiment, 1 to 1.5 μm. Imparting an EDT texture in accordance with the present disclosure using an "embossing stand," i.e. a set of rolls having the dimensions and pressure characteristics used in embossing, may therefore represent a low cost and effective alternative to applying the EDT texture in a skin pass or cold mill. Imparting an EDT texture with an "embossing machine" is a new use for and modification of an embossing machine in that the rolls used are imparted with an EDT texture rather than an embossing pattern. The EDT texture, unlike an embossing pattern, does not bend or deform the thickness of a sheet to yield a visible pattern, but instead redistributes a very thin surface layer of the sheet in the scale of 1 μm to 5 μm to confer an EDT texture to the sheet. Unlike an embossed representational pattern, such as a geometric or floral pattern, the EDT texture is not macroscopic, but is visually observable by the way that the sheet interacts with light impinging on the surface with respect to it's reflectivity, diffusiveness, degree of mirror likeness and isotropy.

An EDT texture is desirable in many applications because it provides a sheet with good appearance, e.g., when used to make a painted automobile body and also aids in forming processes used to make a panel with bends/curves, in that it provides a consistent, non-directional, frictional interaction with tooling used to form the resultant panel shape. In this respect, surface appearance of a sheet may be related to how the surface reflects and scatters light that impinges on its surface. More particularly, a surface may behave as a mirror which reflects incoming light in one direction (specular); it can scatter incoming light in all directions equally (isotropic) or it may scatter incoming light in a plane or planes (directional), e.g., due to the existence of distinct surface patterns in the surface, such as light scattered transverse to a roll grind pattern.

Figure 2:
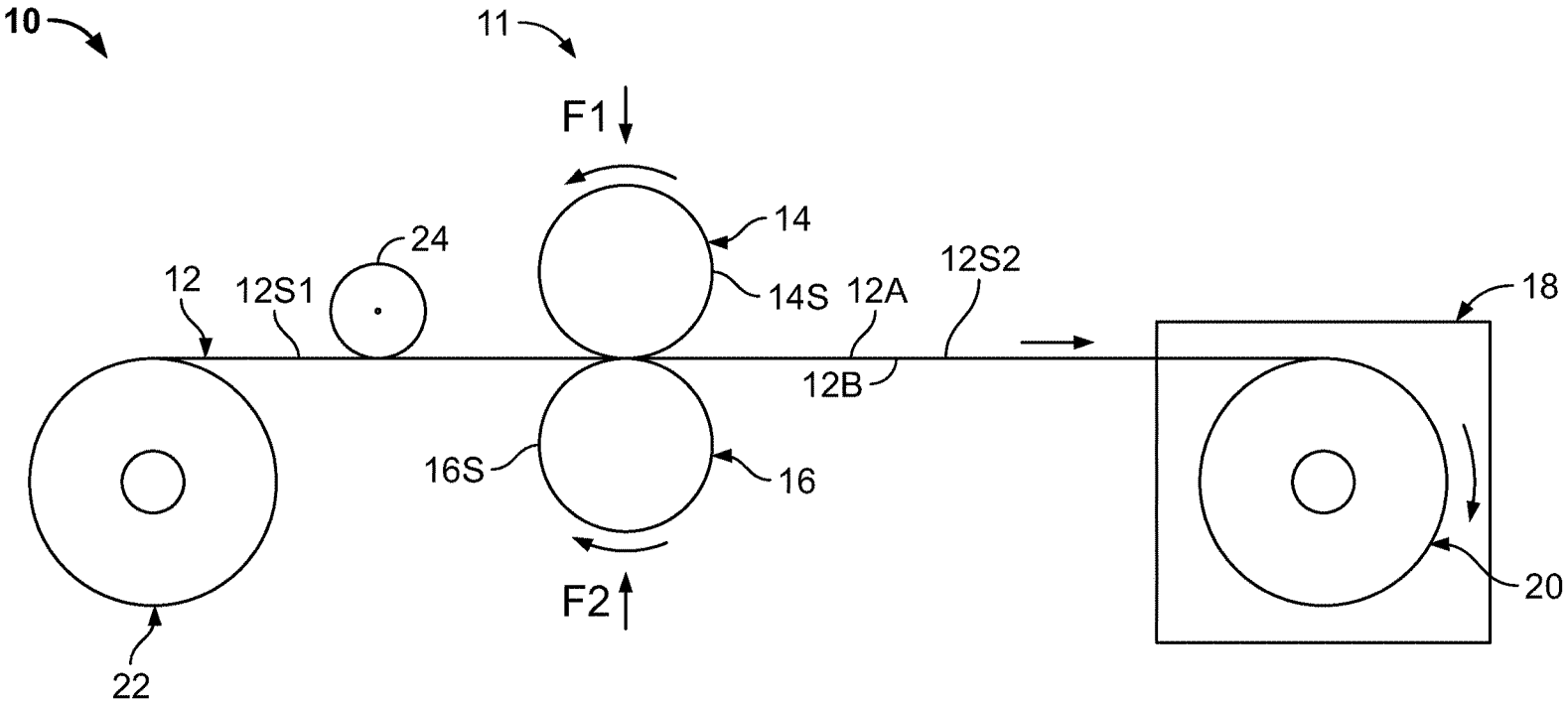
FIG. 2 is a diagram of a rolling apparatus in accordance with an embodiment of the present disclosure.

FIGS. 1 and 2 show a rolling apparatus 10 for processing a sheet 12, e.g., of aluminum. The rolling apparatus 10 has a texturing stand or station 11 with an upper roll 14 and a lower roll 16 (FIG. 2). The sheet 12 passes between the rolls 14, 16 and in so doing is transitioned from a first state 12S1, having a first surface texture (incoming mill finish resulting from prior rolling practices) to a second state 12S2 having a second texture, e.g., in whole or part an EDT surface texture. The sheet 12 may have a thickness in the range of 0.010" to 5.0 μm, in another embodiment from 0.5 μm to 5.0 μm and 0.010 to 0.100 μm in another embodiment. The upper roll 14 and/or the lower roll 16, which are typically formed from steel or steel alloys, may be provided with a surface 14S, 16S, respectively, having a surface roughness Sa ranging from 0.5 to 5.0 μm, in another embodiment from 0.5 to 2.0 μm, in another embodiment, from 0.5 μm to 1 μm and a peak count of 20 to 100/cm using a cutoff threshold +/− Sa/2. This roll surface 14S, 16S texture may be imparted to the rolls 14, 16 via various stages of grinding, polishing, shot-peening, laser etching and electro-discharge texturing, as is known in the art for making EDT rolls. The rolls 14, 16 may have a radius of 300 mm to 500 mm In one alternative, the rolls 14, 16 may be provided with a convex crown to compensate for deflection during rolling. For example, a crown of 0.025 inches (0.635 mm) may be made on the unloaded rolls 14, 16 as measured. This amount of crown will allow the rolls 14, 16 to meet at the sheet 12 along their width (parallel to the axis of rotation) when subjected to roll force F1, F2. The radius of rolls 14, 16 is in the range of 300 to 500 mm, which is much larger than the radius of rolls used for making substantial reductions during hot or cold rolling, which typically have a radius of 250 to 400 mm. An aspect of the present disclosure is the recognition that large diameter rolls 14, 16 provide a larger arc of contact and a less severe angle of approach of the EDT texture to the sheet at the nip. This decrease in angle of approach puts less strain on the roll/sheet Interface, resulting in less wear of the textured roll 14, 16, less smearing of the applied texture and less debris created.

The rolling apparatus 10 of FIG. 2 may be a two-high embossing machine. The rolls 14, 16 are generally not driven by motors, etc. and the sheet 12 is pulled through the rolls 14, 16 by a coiling system 18 driving a take-up coil 20, which pulls the sheet 12 from a feed coil 22 through the rolls 14, 16 and winds it onto the take-up coil 20. In an alternative approach, instead of feed coil 22, the sheet 12 may be provided at state 12S1 by an output of a rolling mill or other pre-processing apparatus. Since the rolls 14, 16 are driven by the sheet 12, rather than vice versa, and the sheet 12 moves the rolls 14, 16 synchronously by frictional engagement, minimizing relative sliding. Driving the sheet 12 by the coiling system 18 is possible because the forces F1, F2 at rolls 14, 16 are low compared to traditional EDT texturing approaches and result in minimal reduction in thickness of the sheet 12, e.g., in the range of 0 to 1%. Accordingly, the apparatus 10 and method of use described above is suitable for applying a surface texture to a sheet 12 of metal, e.g., aluminum sheet, that has already been rolled to, or close to, a final thickness, e.g., from 0.010 to 5.0 mm in one embodiment, from 0.030 to 0.100 mm in another embodiment and 0.7 mm to 1.2 mm thick in another embodiment. For certain applications, such as auto body panel use, the sheet 12 at state 12S2 preferably has a surface texture within a given target range of surface roughness and appearance qualities, e.g., 1 μm to 1.5 μm Sa.

An aspect of the present disclosure is the recognition that under the EDT texturing conditions described above for imparting an EDT texture with apparatus 10, minimal lubricant is required, such that residual lubricant that persists on the sheet 12 from prior rolling operations is sufficient. This is a departure from conventional practices that assume that lubricant is required during the process of applying an EDT texture. Lubricant is required in conventional EDT texturing due to the substantial reductions taken and to allow some slipping of the sheet relative to the rolls. Since, in accordance with the present disclosure, there is minimal reduction occurring at the rolls 14, 16, lubricant beyond residual lubricant is not required. Excessive lubricant coats the sheet 12 giving it an effectively greater thickness when passing between the rolls 14, 16 and decreasing contact with the textured surface of the rolls 14, 16, thereby inhibiting texture transfer and increasing the probability of the sheet slipping relative to the rolls 14, 16 as it is pulled through the rolls 14, 16 by the coiling system 18. In one embodiment, a sheet cleaning device, such as a buff wheel 24 or water jet (not shown) may be employed to clean the sheet 12 of debris and excess lubricant prior to passing through the rolls 14, 16. The absence of large quantities of lubricant and dirt (associated with traditional EDT texturing at larger reductions) from the sheet 12 and apparatus 10, leads to a cleaner rolling operation, alleviating apparatus and methods for removing dirt and lubricant from the sheet prior to wind-up on wind-up coil 20.

In accordance with the present disclosure, the scale of surface deformation by apparatus 10 is very small, e.g., about 1 μm to 5 μm, which is much smaller than the scale at which "embossing" is conducted. For that reason, applying an EDT texture as described herein can not be described as "embossing," as that term is typically used. Rather, the present disclosure describes using an embossing machine under significantly different operating parameters with rolls 14, 16 that have an EDT texture, rather than an embossing pattern, to conduct EDT texturing. This sliding distance with reduction accounts for the reduction in debris generation typical of EDT texturing. An aspect of the present disclosure is the selection of rolls 14, 16 with a suitable radius. More particularly, the rolls 14, 16 having a radius of 300 mm to 500 mm, which under the rolling forces F1, F2 consistent with the present disclosure, will exhibit an acceptable amount of crowning (side to side bending of the rolls 14, 16, minimizing uneven transfer efficiency across the face of the rolls 14, 16.

While the foregoing disclosure identifies an embossing machine as a suitable apparatus for conducting an EDT rolling operation in accordance with the present disclosure, it should be understood that any rolling device having the attributes noted above, namely, a rolling apparatus having the capability of passing a sheet through EDT surfaced rolls at a roll pressure of 100 to 400 metric tons. The rolls must be of a suitable diameter for the length thereof with a designed roll crown to give a transfer rate of at least 80% to 100%. Since these requirements are met by an embossing machine, which is typically a two-high rolling apparatus, it is an economical choice for conducting EDT texturing in accordance with the present disclosure, but the present disclosure is not limited to this configuration for a rolling apparatus. The line speed achievable with a device 10 like that disclosed is about 10 to 500 m/min. This compares to the line speed of 400 to 1500 m/min for a typical sheet mill.

Figure 3:
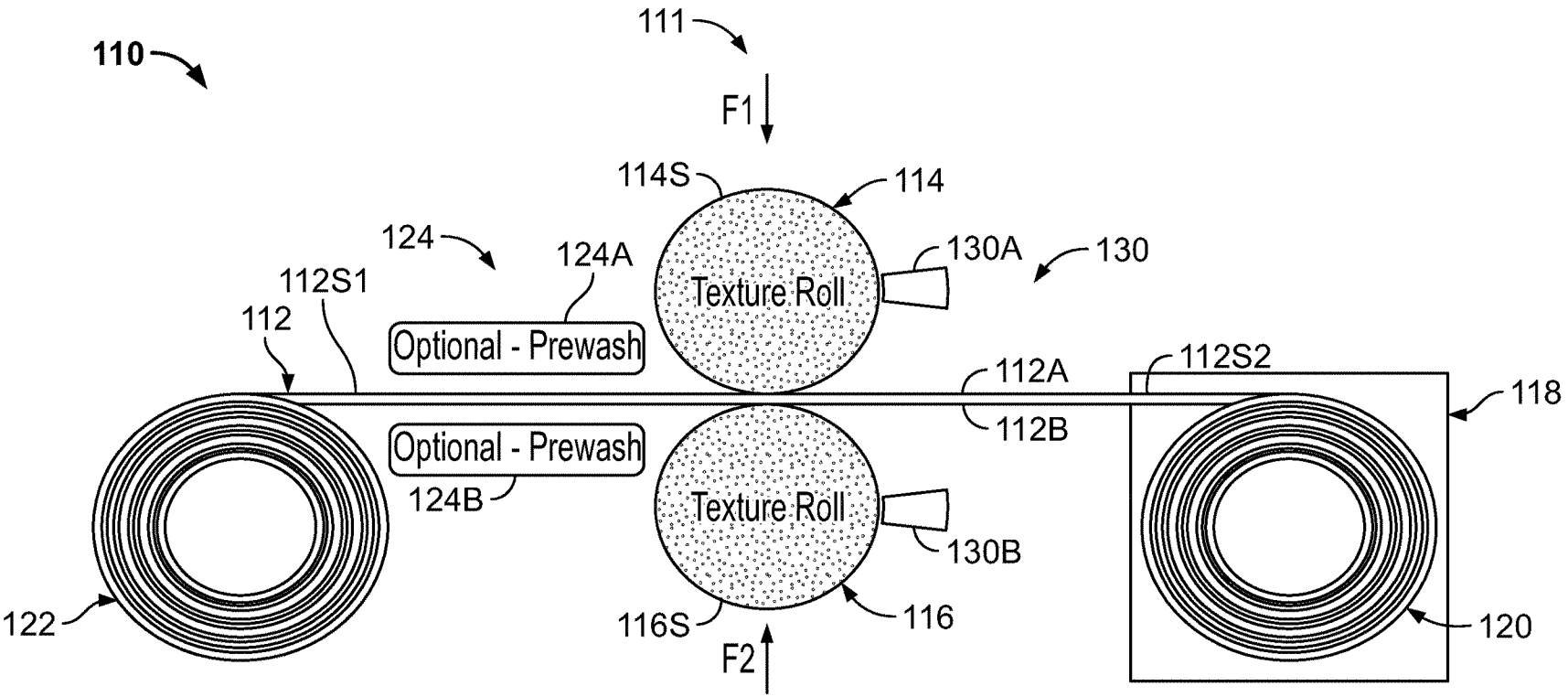
FIG. 3 is a diagram of a rolling apparatus in accordance with an alternative embodiment of the present disclosure.

FIG. 3 shows a rolling apparatus 110 like apparatus 10 of FIG. 2 for processing a sheet 112, e.g., of aluminum. The rolling apparatus 110 has a texturing stand or station 111 with an upper roll 114 and a lower roll 116. The sheet 112 passes between the rolls 114, 116 and in so doing is transitioned from a first state 112S1, having a first surface texture (incoming mill finish resulting from prior rolling practices) to a second state 112S2 having a second texture, e.g., in whole or part an EDT surface texture. The parameters described above in reference to FIG. 2 may be taken to be the same or similar in reference to FIGS. 3, 4 and 5, e.g., with respect to: surface texture of the sheet 112, surface roughness, surface appearance, yield strength, material composition, sheet 112 thickness, roll 114 composition, surface roughness, surface preparation, radius, crown, roll force F1, F2, type of embossing machine, sheet drive, etc. In FIG. 3, the sheet 112 on the coil 122 may have been previously produced, e.g., by a rolling mill, which included both hot and cold rolling to produce the sheet near or at the finished dimensions. In one alternative, the sheet 112 has been previously thermally treated prior to unwinding from the coil to pass it through rolls 114, 116. In another alternative, the sheet 112 may be heat treated after passing through the rolls 114, 116 and/or after coiling into coil 120. Since the rolls 114, 116 are driven by the sheet 112, rather than vice versa, the sheet 112 moves the rolls 114, 116 synchronously by frictional engagement, minimizing relative sliding. Elimination of sliding of the sheet 112 relative to the rolls 114, 116 eliminates the blurring of the texture imparted by the rolls 114, 116. Driving the sheet 112 by the coiling system 118 is possible because the forces F1, F2 at rolls 114, 116 are low compared to traditional EDT texturing approaches. The roll forces F1, F2 applied, result in minimal reduction in thickness of the sheet 112, e.g., <1%. Minimal/no reduction in thickness is also consistent with the objective of avoiding blurring of the EDT texture, in that substantial reductions involve a sheet speed change proximate the nip between rolls 114, 116 associated with the increased length/reduced thickness of the sheet. The low levels of roll force associated with minimal/no reduction result in far better resolution, e.g., by a factor of 5 to 10 over a normal rolling procedures, which enables more accurate control of the surface imparted to the sheet. In one embodiment of the present disclosure, the roll force level may be maintained by hydraulic cylinder(s) or mechanical actuator(s). The roll force may be measured by load cells and/or pressure transducers and the force data used to control the hydraulic or mechanical actuator(s) that regulate the roll force.

The roll force may be maintained within a range of +/− 0.3 to 0.5% of total roll force. In another embodiment, the roll force is maintained within a range of +/− 0.1% of total roll force. In another embodiment, the roll force is maintained within a range of +/− 1 to 5 tons of the total roll force.

An aspect of the present disclosure is the recognition that under the EDT texturing conditions described above for imparting an EDT texture with apparatus 110, minimal/no lubricant is required. This is consistent with the prevention of relative sliding between the sheet 112 and the rolls 114, 116. In addition, the presence of lubricant reduces the contact between the sheet 112 and the rolls 114, 116, reducing the transfer efficiency. This is especially the case in the context of taking very low/no reduction in thickness of the sheet 112 by the embossing rolls 114, 116 at low force levels. FIG. 3 shows that a pre-wash apparatus 124 with washers 124A, 124B, such as a water jet, may be employed to clean one or both sides 112A, 112B of the sheet 112 of debris and excess lubricant prior to passing through the rolls 114, 116. The absence of lubricant and dirt from the sheet 112 and apparatus 110, leads to a more effective texturing operation, i.e., greater fidelity to the EDT texture and greater transfer %. The texture of the rolls 114, 116 may also be preserved during use by a roll cleaning system 130 with roll cleaners 130A, 130B, such as a buffer, wiper or blade that plays over the rolls 114, 116 during texturing, continuously cleaning debris from the rolls 114, 116 that otherwise would clog the texture of the rolls 114, 116 and/or impress itself into the surface of the sheet 112. In the alternative, the roll cleaners 130A, 130B may be in the form of a high pressure water spray or a laser. In another alternative, a post-wash system like the pre-wash apparatus 124 may be used on the sheet 112 after passing through rolls 114, 116 to remove dirt and lubricant from the sheet 112 prior to wind-up on wind-up coil 120.

The rolling apparatus 110 may be a stand-alone, single embossing stand with a relatively small footprint compared to a cold rolling machine. Optionally, the rolling apparatus 110 may be portable/movable, in that it may be selectively positioned or removed from association with a rolling line to allow texturing of the sheet output from the roll line or running the rolling/process line at high speed without EDT texturing. The rolling apparatus may be sized to be appropriate for the rolling capacity needed and does not need to be directly inserted into a roll line. Since roll lines are designed to have a high throughput, the insertion of a roll that imparts EDT tends to slow up an existing roll line and diminishes productivity. Since not all sheet product produced by a given roll line will need to be EDT textured, the separation of EDT texturing from the rolling line at a separate apparatus preserves the output capacity of the rolling line while giving the option to texture any given quantity (subset) of sheet produced by a rolling mill. The EDT texture imparted by the apparatus 110 at state 112S2 has an isotropic matte finish, suitable, e.g., for auto body panels. The texturing is conducted with improved texture transfer with less debris under less force, extending texture roll 114, 116 useful life. Increased roll life translates to fewer roll changes and less resulting down-time. The resulting sheet 112 has a better, consistent finish and is cleaner due to the roll and sheet cleaning steps conducted, as well as decreased debris generation.

Figure 4:
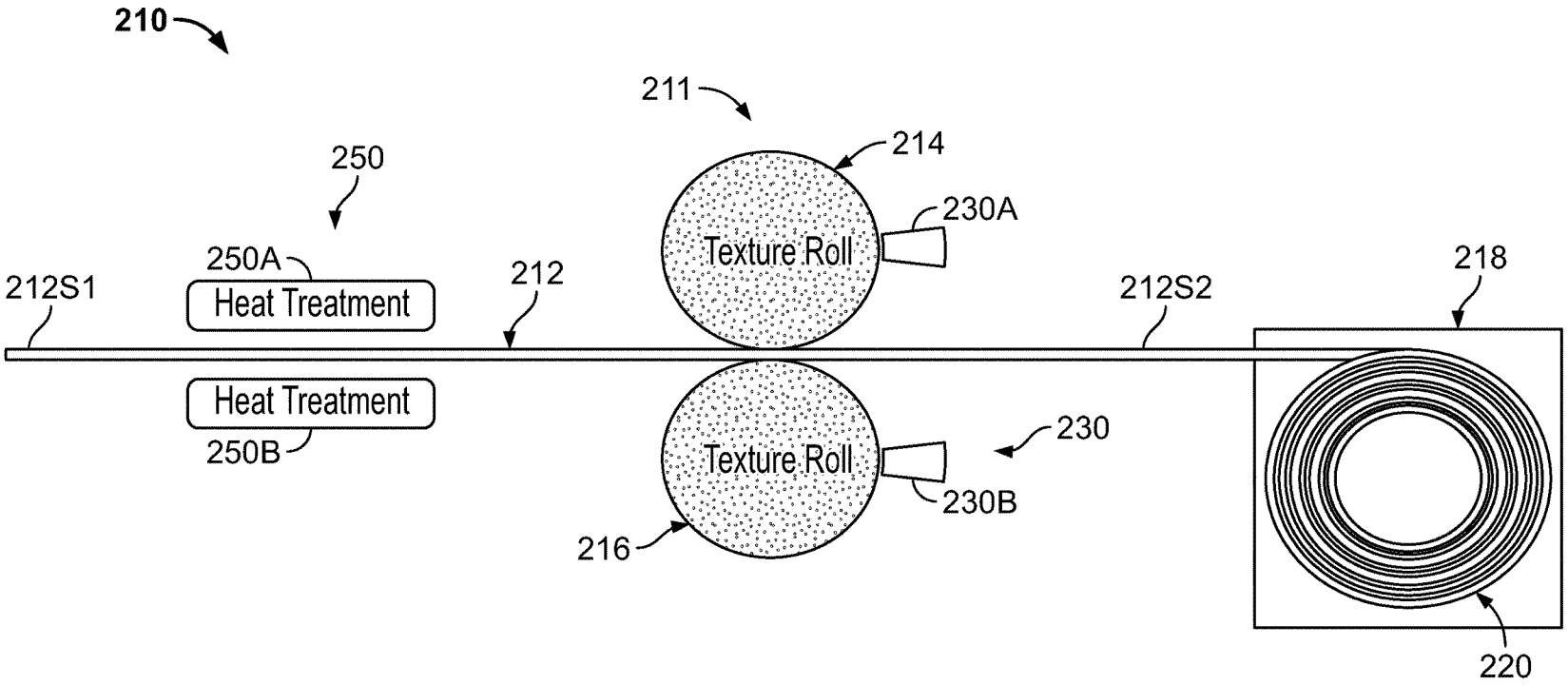
FIG. 4 is a diagram of a rolling apparatus in accordance with an alternative embodiment of the present disclosure.

FIG. 4 shows a rolling apparatus 210 like apparatus 10 of FIG. 2 for processing a sheet 212, e.g., of aluminum. The rolling apparatus 210 has a texturing stand or station 211 with an upper roll 214 and a lower roll 216. The sheet 212 passes between the rolls 214, 216 and in so doing is transitioned from a first state 212S1, having a first surface texture (incoming mill finish resulting from prior rolling practices) to a second state 212S2 having a second texture, e.g., in whole or part an EDT surface texture. The sheet 212 is then wound by a coiling apparatus 218 on coil 220. Prior to texturing by rolls 214, 216, the sheet 212 is heat treated by a thermal treatment station 250, which may include a plurality of heaters 250A, 250B, such as electric induction heaters or gas heaters. Optionally, cooling stations, such as cold water sprays, baths, air knives, etc. and/or a leveler stretcher (not shown) may be used in the thermal treatment station 250. In FIG. 4, the sheet 212 may have been previously produced, e.g., by a rolling mill, to produce the sheet 212 near or at the finished dimensions. The sheet 212 may therefore be a direct product of a rolling mill or may have been previously coiled into a coil like coil 120 after production and then uncoiled for heat treatment and texturing by the apparatus 210. The thermal treatment station 250 may avoid the necessity of removing lubricant by a pre-washing system like system 124 of FIG. 3 due to the heat evaporating the lubricant from the surface of the sheet 212. Optionally, a surface cleaner (not shown) such as a vacuum, air knife or brush may be utilized to remove debris from the surface of the sheet 212 prior to texturing by rolls 214, 216.

As in the system 110 of FIG. 3, the texture of the rolls 214, 216 may be preserved by a roll cleaning system 230 with roll cleaners 230A, 230B, such as a buffer, wiper, blade, high pressure water spray or a laser that plays over the rolls 214, 216, continuously cleaning debris from the rolls 214, 216 that otherwise would clog the texture and/or impress itself into the surface of the sheet 212. A post-wash system like the pre-wash apparatus 124 may be used on the sheet 212 after passing through rolls 214, 216 to remove dirt and lubricant from the sheet 212 prior to wind-up on wind-up coil 220 by coiling system 218. The effectiveness of the process illustrated in FIG. 4 exhibits improved texture transfer from lower mill loads with fewer sheet blemishes and produces a consistent sheet surface that may allow elimination of a cold pass, i.e., a final pass through a cold mill utilizing rolls with an EDT texture at reductions of 3-5% or 8-10%.

Figure 5:
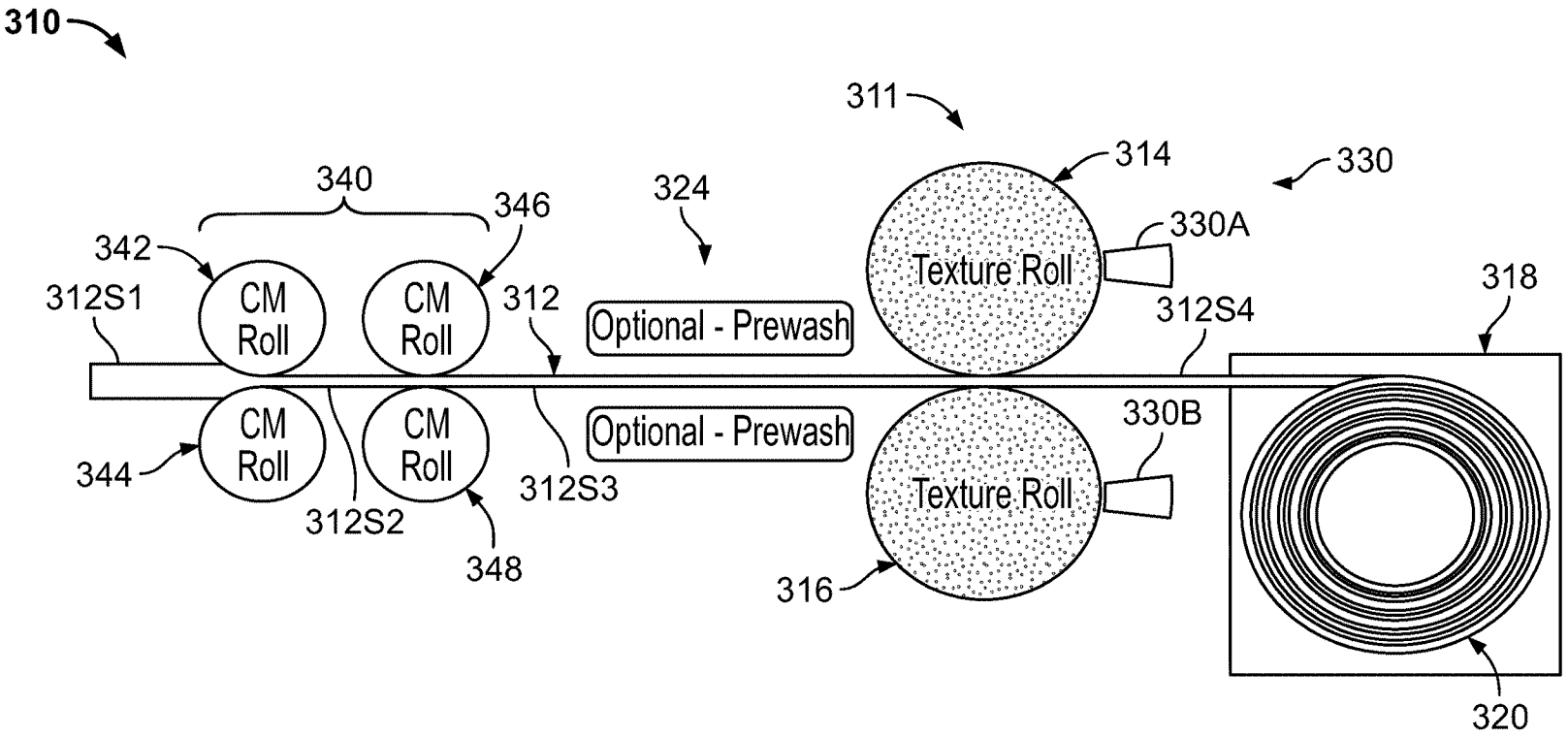
FIG. 5 is a diagram of a rolling apparatus in accordance with an alternative embodiment of the present disclosure.

FIG. 5 shows a rolling apparatus 310 which has a texturing stand or station 311 with an upper texture roll 314 and a lower texture roll 316. The sheet 312 passes between the rolls 314, 316 and in so doing is transitioned from a preceding state 312S3, having a first surface texture (incoming mill finish resulting from prior rolling practices) to a subsequent state 312S4 having a second texture, e.g., in whole or part an EDT surface texture. The sheet 312 is then wound by a coiling apparatus 318 on coil 320. Prior to texturing by rolls 314, 316, the sheet 312 is cold rolled from a first state 312S1 to a second state 312S2 and then to a third state 312S3 in a cold rolling apparatus 340, which may include one or more cold rolling stations. For example a first station having rolls 342 and 344 conducts a first reduction on the sheet 312 and a second station having rolls 346 and 348 conducts a second reduction. In FIG. 5, the sheet 312 at state 312S1 may have been previously produced, e.g., by a hot rolling mill. The cold rolling apparatus 340 implies that a lubricant is likely used during cold rolling and consistent with the present disclosure, the lubricant may be removed by a pre-washing system 324. As is FIGS. 1-4, large diameter EDT texture rolls 314, 316 impart an EDT texture to the incoming sheet at state 312S3 to produce textured sheet at state 312S4. As before, the texturing is done at low/no reduction on a clean sheet 312 with little/no lubricant present.

As in the system 110 of FIG. 3, the texture of the rolls 314, 316 may be preserved by a roll cleaning system 330 with roll cleaners 330A, 330B, such as a buffer, wiper, blade, high pressure water spray or a laser that plays over the rolls 314, 316, continuously cleaning debris from the rolls 314, 316 that otherwise would clog the texture and/or impress itself into the surface of the sheet 312. A post-wash system like the pre-wash apparatus 324 may be used on the sheet 312 after passing through rolls 314, 316 to remove dirt and lubricant from the sheet 312 prior to wind-up on wind-up coil 320 by coiling system 318. In this approach, use of texturing rolls 314, 316 at low/no reduction in an embossing stand may be used to add texture to the sheet at the end of a cold rolling operation prior to coiling. This approach eliminates the need for coiling the sheet after passing through a cold roll mill and then uncoiling it to apply an EDT texture. The texturing station 311 using rolls 314 and 316 may be a retrofit to a cold rolling mill or process line and may be portable/removable to permit running a cold rolling line with or without the texturing station. In another embodiment, the EDT rolling stand is selectively on/off line or opened and closed to allow running the roll line with or without the EDT rolling stand.

It will be understood that the embodiments described herein are merely exemplary and that a person skilled in the art may make many variations and modifications without departing from the spirit and scope of the claimed subject matter. All such variations and modifications are intended to be included within the scope of the disclosure.

We claim:

1. A method for applying texture to a metal sheet, comprising:

cold rolling the metal sheet at a rolling stand with a roll having an EDT surface, wherein the roll applies a roll force to the metal sheet, wherein the roll force reduces a thickness of the metal sheet by <1%, wherein the roll force produces a texture on the metal sheet, and wherein after the cold rolling the metal sheet has a surface roughness of from 1 μm to 5 μm with a transfer percentage of >80%.

2. The method of claim 1, wherein, the roll force is maintained by at least one of at least one hydraulic cylinder or mechanical actuator.

3. The method of claim 1, wherein, the roll force is maintained from +/−0.3 to 0.5% of total roll force.

4. The method of claim 1, wherein, the roll force is maintained from +/−1 to 5 tons of total roll force.

5. The method of claim 1, wherein, the roll force is measured by load cells or pressure transducers and force data is used to control hydraulic or mechanical actuator(s) that regulate the roll force.

6. The method of claim 1, wherein the surface roughness on the metal sheet is from 1 to 1.5 μm Sa.

7. The method of claim 1, wherein a surface of the metal sheet is redistributed by the step of cold rolling to a depth of from 1 to 2 μm.

8. The method of claim 1, wherein the metal sheet has a width of from 1.5 m to 1.85 m and the roll force exerted by the roll having the EDT surface is from 200 to 350 metric tons.

9. The method of claim 1, wherein the step of cold rolling is conducted by a 2 high rolling stand.

10. The method of claim 9, wherein the 2 high rolling stand is an embossing mill with at least one roll being the roll having the EDT texture.

11. The method of claim 10, wherein both rolls of the 2 high rolling stand are EDT textured.

12. The method of claim 1, wherein, after the step of cold rolling, the metal sheet has a peak count of 20 to 100 peaks/cm using a cutoff threshold +/−Sa/2.

13. The method of claim 1, wherein the roll having an EDT surface has a radius from 300 to 500 mm.

14. The method of claim 1, wherein the roll having the EDT surface has a crown of 0.635 mm.

15. The method of claim 1, wherein the metal sheet is pulled through the rolling stand and drives the roll having the EDT surface.

16. The method of claim 1, wherein the metal sheet is driven through the rolling stand.

17. The method of claim 1, wherein the metal sheet is an output of a rolling mill.

18. The method of claim 1, wherein, prior to the step of cold rolling, the metal sheet is from 0.03 mm to 0.100 mm in thickness.

19. The method of claim 1, wherein, prior to the step of cold rolling, the metal sheet is from 0.5 mm to 20 mm in thickness.

20. The method of claim 1, wherein, prior to the step of cold rolling, the metal sheet is not greater than 1.1 mm in thickness.

21. The method of claim 1, wherein, prior to the step of cold rolling, no lubricant is applied to the metal sheet.

22. The method of claim 21, comprising, prior to the step of cold rolling, cleaning the metal sheet.

23. The method of claim 1, comprising, after the step of cold rolling, cleaning the roll having an EDT texture.

24. The method of claim 1, wherein a line speed of the metal sheet during the step of cold rolling is from 50 to 500 m/min.

25. The method of claim 1, wherein the rolling stand is selectively positionable in a roll line to allow running the roll line with or without the rolling stand.

26. The method of claim 1, wherein the rolling stand is selectively on/off line or open/closed in a roll line to allow running the rolling line or processing line with or without the rolling stand.

27. The method of claim 1, comprising forming a vehicle panel from the metal sheet after the step of rolling.

28. A sheet produced by the method of claim 1.

* * * * *